US005625995A

United States Patent [19]

Martin

[11] Patent Number: 5,625,995

[45] Date of Patent: May 6, 1997

[54] METHOD AND FLOORING SYSTEM WITH ALIGNING BRACKET FOR MUTUALLY SECURING A HEADER, A JOIST AND A BASE

[75] Inventor: Byron L. Martin, Columbia, S.C.

[73] Assignee: Consolidated Systems, Inc., Columbia, S.C.

[21] Appl. No.: 276,320

[22] Filed: Jul. 15, 1994

[51] Int. Cl.[6] ..... E04B 1/38

[52] U.S. Cl. ..... 52/715; 52/702; 52/650.3; 52/655.1; 52/665; 52/737.2

[58] Field of Search ..... 52/712, 714, 715, 52/289, 695, 702, 737.2, 736.2, 665, 650.3, 655.1, 299

[56] References Cited

U.S. PATENT DOCUMENTS

| | | | |
|---|---|---|---|
| 813,253 | 2/1906 | Sullivan | 52/715 X |
| 1,765,107 | 6/1930 | Snyder | 52/702 |
| 2,704,868 | 3/1955 | Danielson | 52/715 |
| 3,184,800 | 5/1965 | Nelson | 52/714 X |
| 3,216,160 | 11/1965 | Best | 52/715 |
| 3,537,221 | 11/1970 | Helfman et al. | 52/714 |
| 3,902,298 | 9/1975 | Ratliff, Jr. | 52/665 X |
| 4,517,776 | 5/1985 | Barker | 52/712 X |
| 5,186,571 | 2/1993 | Hentzschel | 52/712 X |

FOREIGN PATENT DOCUMENTS

| | | | |
|---|---|---|---|
| 238822 | 9/1986 | Sweden | 52/714 |

*Primary Examiner*—Carl D. Friedman
*Assistant Examiner*—Yvonne Horton-Richardson
*Attorney, Agent, or Firm*—Rogers & Killeen

[57] ABSTRACT

A blank of a bracket, a bracket, a system using a bracket and a method for mutually securing two or more of a header, a joist and a base, for accurately positioning a header with respect to a base, and for stiffening the webs of a header and a joist to thereby prevent crippling or bending of the webs and to thereby prevent the joist from rolling from side to side. A metal blank can be formed into a bracket which can be used in a system having a header, plural joists and a base whereby the bracket is secured to the header, joist and base for stiffening the webs of C-shaped and/or Z-shaped headers and joists and for aligning and mutually securing the header, joist and base.

49 Claims, 1 Drawing Sheet

METHOD AND FLOORING SYSTEM WITH ALIGNING BRACKET FOR MUTUALLY SECURING A HEADER, A JOIST AND A BASE

BACKGROUND OF THE INVENTION

The present invention relates to a system and method for mutually securing together a header, a joist and a base, and to a blank for forming a bracket and a bracket for use in such system and method. More particularly, the blank is a flat sheet of metal which can be formed into a one-piece bracket; the bracket is a web stiffener, a fastening device and an aligning device; and the system and method relate to a floor system having a header, multiple joists and multiple brackets where the brackets stiffen the webs of C-shaped or Z-shaped metal headers and joists, mutually securing the header, the joist and the base and positioning the header with respect to the base.

In the construction field it is known to construct a support system for a floor or roof or other generally planar surface by abutting a plurality of joists to a header and supporting the joists and header on a base. The plural joists are generally parallel so to form a structure over which a horizontal surface (e.g. plywood, sheet metal, etc.) can be laid to thereby form a platform for use as a floor or roof or otherwise. A problem with such support systems is that they may be subject to lifting forces, such as wind, which tend to lift the header and joist from the base or the joist from the header.

It is common for the joists and header to be wood, e.g., 2"×8" or 2"×12". However, the joists and/or the header in these support systems are increasingly comprised of light gauge steel due to the rising cost and declining quality of wood. Such steel members are generally C-shaped or Z-shaped whereby each joist and header has a vertical web and horizontal upper and lower surfaces extending laterally from the web. While providing economic advantages, such C-shaped and Z-shaped metal joists and headers do not have the rigidity of wood and thus present unique problems for support systems when used therein.

One problem with these support systems is that the light gauge webs of the metal joists and headers tend to cripple or bend under load conditions. Such joists and headers also tend to twist and roll from side to side under load.

Another problem with constructing such support systems is the accurate positioning of the header with respect to the base.

Currently, these problems are solved by using one device to stiffen the web of the joist and the header, a second device to fasten the header to the base and a third device to fasten the joist to the base. On occasion, a fourth device is used to determine the appropriate distance from one lateral edge of the base to the header, thereby positioning the entire system.

It is, accordingly, an object of the present invention to solve the above mentioned problems and to provide a novel one-piece bracket for mutually securing at least two of a header, a joist and a base.

It is another object of the present invention to provide a novel one-piece bracket which stiffens the web of the joist and the header to thereby prevent web crippling and joist roll.

It is still another object of the present invention to provide a novel one-piece bracket for quickly and accurately positioning a header with respect to a base.

It is still yet another object of the present invention to provide a novel one-piece bracket for quickly and accurately securing a joist to a base.

It is yet another object of the present invention to provide a novel system for supporting a generally planar surface.

It is still yet another object of the present invention to provide a novel one-piece bracket for anchoring a planar system against uplift from winds.

It is still a further object of the present invention to provide a novel blank which can be formed into a bracket for mutually securing two or more of a header, a joist and a base.

It is yet still a further object of the present invention to provide a novel method of mutually securing one or more of a metal header, metal joist and a base.

These and many other objects and advantages will be readily apparent to one skilled in the art to which the invention pertains from a perusal of the claims and the following detailed description of preferred embodiments when read in conjunction with the appended drawings.

DESCRIPTION OF PREFERRED EMBODIMENTS

Figure 1:
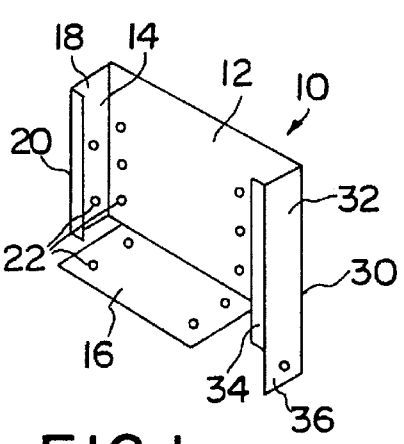
FIG. 1 is a pictorial representation of one embodiment of the bracket of the present invention.

One embodiment of the bracket of the present invention is shown in FIG. 1. With reference to FIG. 1, the bracket 10 may be one-piece and may include a back plate 12, a first side plate 14 extending laterally from a side of the back plate 12 and a base plate 16 extending laterally from the bottom of the back plate 12. In the preferred embodiment, the first side plate 14 is desirably normal to the back plate 12 for stiffening the back plate 12 and may be L-shaped with a major portion 18 contiguous to the back plate 12 (which stiffens the back plate 12) and a minor terminal portion 20 (which stiffens the major portion 18). The back plate 12, first side plate 14 and base plate 16 are each adapted to be attachable to a surface. Apertures 22 may be provided for attaching the bracket to various surfaces by any suitable conventional fasteners such as threaded screw or nails.

Figure 3:
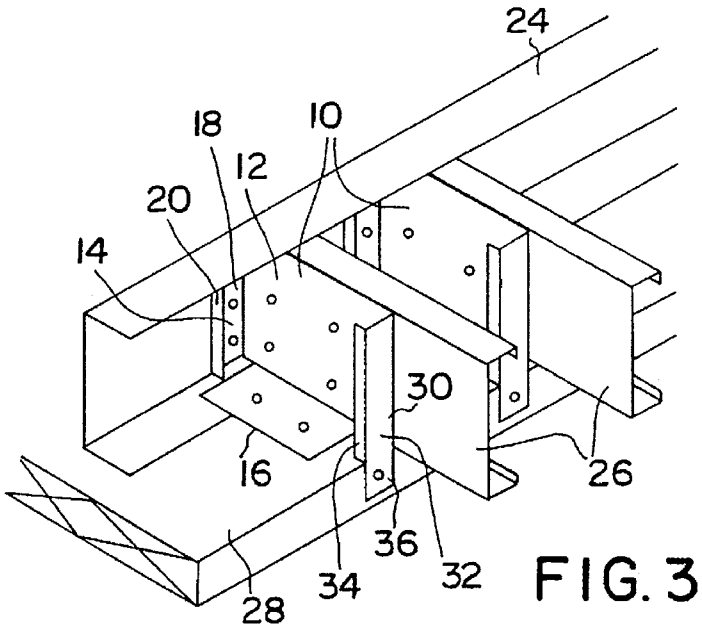
FIG. 3 is a pictorial representation of one embodiment of the system of the present invention using the bracket of FIG. 1.

FIG. 3 shows one embodiment of the system of the present invention using the bracket shown in FIG. 1. With reference to FIG. 3, the system may include a header 24, plural joists 26 abutting the header 24, a base 28 supporting the header 24 and plural joists 26, and plural brackets 10. As shown, the back plate 12 of the bracket 10 is attached to the web of a joist 26, the major portion 18 of the first side plate 14 is attached to the web of a header 24 abutted by the joist 26, and the base plate 16 is attached to the base 28 which supports both the header 24 and the joist 26. When attached, the first side plate 14 which stiffens the back plate 12 would thereby also stiffen the web of the joist 26 to which the back plate 12 is attached. The minor terminal portion 20 which stiffens the major portion 18 would thereby also stiffen the web of the header 24 to which the major portion 18 is attached. In this way, the joist 26 is less likely to roll from side to side and the web of the joist 26 and the header 24 is less likely to buckle or bend. Because of the attachment of the base plate 16 to the base 28, the support system is less susceptible to uplifting forces.

With continued reference to the preferred embodiment of the system illustrated in FIG. 3, the bracket 10 includes a second side plate 30 extending laterally from the other side of the back plate 12 to thereby stiffen the back plate 12. The second side plate 30 is preferably L-shaped with a major portion 32 contiguous to the back plate 12 and a minor terminal portion 34 which extends towards the first side plate 14 and which stiffens the major portion 32. The second side plate 30 may also include an extension 36 co-planar with the major portion 32 of the second side plate 30 and attached to a side surface of the base 28. In this way, the support system is even less susceptible to uplifting forces and the bracket 10 provides a discrete measuring device for positioning a header 24 with respect to a base 28. The width of the extension 36 may be equal to or less than the length of the major portion 32 of the second side plate 30.

In the preferred embodiment, the base plate 16 overlies a portion of the header 24 and does not interfere with the first and second side plates 14 and 30. Generally, the width of base plate 16 may be equal to or less than the width of the back plate 12 and the length of the first and second side plates 14 and 30 respectively may be equal to, or less than, the length of the back plate 12.

With continued reference to the preferred embodiment of the system illustrated in FIG. 3, the header 24 and each of the joists 26 are made of C-shaped metal having a generally vertical web and upper and lower extensions such that the joist abuts the inside facing web of the header, the back plate 12 is attached to the outside facing web of the joist 26 and the first side plate 14 is attached to the inside facing web of the header 24. In another embodiment, the joists abut and the first side plate 14 is attached to the outside facing web of the header 24.

Figure 4:
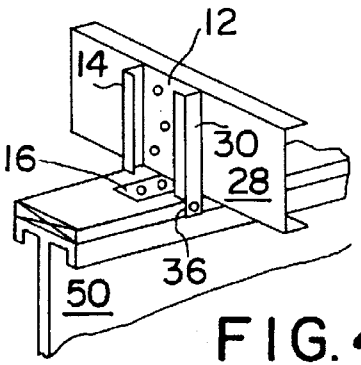
FIG. 4 is a pictorial representation of one embodiment of the bracket of the present invention used in attaching a joist to a girder.

The bracket of FIG. 1 may also be used to secure a joist to a girder as shown in FIG. 4. While not necessary, the two side plates 14 and 30 may both be provided with extensions 36 dimensioned to position the bracket with respect to the girder 50 and to be secured to the girder 50 to resist wind lift as well as resisting web crippling and rolling of the joist 28 intermediate its length under load conditions.

Figure 2:
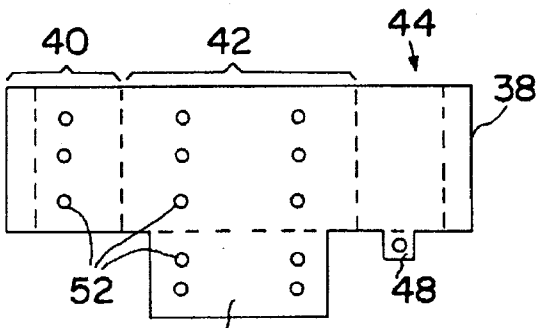
FIG. 2 is a top plan view of a blank of the present invention which may be used in the formation of the bracket of FIG. 1.

FIG. 2 shows one embodiment of a blank for forming the bracket of FIG. 1. With reference to FIG. 2, the blank includes a rectangular metal plate 38 having a length approximately three times that of the width where the metal plate includes first, second and third generally square portions 40, 42 and 44 respectively, a first lateral extension 46 from one side of the second portion 42 and a second extension 48 from a side of the third portion 44. The blank may include apertures 52 in the first portion 40, the second portion 42 and the extensions 46 and 48.

While preferred embodiments of the present invention have been described, it is to be understood that the embodiments described are illustrative only and the scope of the invention is to be defined solely by the appended claims when accorded a full range of equivalence, with many variations and modifications naturally occurring to those skilled in the art from a perusal hereof.

What is claimed is:

1. A one piece bracket for mutually securing a header, a joist abutting the header and a base with a generally planar upper surface supporting the abutting header and joist and with a side surface facing away from the header, said bracket comprising:

a back plate adapted to overlie the web of the portion of a joist adjacent an abutting header for attachment thereto;

a first side plate having a major portion extending laterally from the header side of the back plate, the major portion of said first side plate being contiguous to said back plate, stiffening said back plate and being adapted to overlie the web of the header adjacent the abutting joist for attachment thereto, so that the header and the abutting joist may be mutually secured;

a second side plate having a major portion extending laterally from the other end of said back plate, the major portion of said second side plate being contiguous to said back plate and stiffening said back plate; and a base plate extending laterally from the bottom of said back plate for stiffening said back plate, said base plate being adapted to overlie the upper surface of the base for attachment thereto where the base supports the mutually secured header and abutting joist, wherein said first side plate is L-shaped with a minor terminal portion thereof stiffening the major portion thereof.

2. A one piece bracket for mutually securing a header, a joist abutting the header and a base with a generally planar upper surface supporting the abutting header and joist and with a side surface facing away from the header, said bracket comprising:

a back plate adapted to overlie the web of the portion of a joist adjacent an abutting header for attachment thereto;

a first side plate having a major portion extending laterally from the header side of the back plate, the major portion of said first side plate being contiguous to said back plate, stiffening said back plate and being adapted to overlie the web of the header adjacent the abutting joist for attachment thereto, so that the header and the abutting joist may be mutually secured, a second side plate having a major portion extending laterally from the other end of said back plate, the major portion of said second side plate being contiguous to said back plate and stiffening said back plate; and a base plate extending laterally from the bottom of said back plate for stiffening said back plate, said base plate being adapted to overlie the upper surface of the base for attachment thereto where the base supports the mutually secured header and abutting joist, wherein said second side plate is L-shaped with the minor terminal portion thereof stiffening the major portion thereof.

3. The bracket of claim 2 wherein said first side plate is L-shaped with the minor terminal portion thereof stiffening the major portion thereof.

4. The bracket of claim 2 wherein said second side plate includes an extension coplanarly depending from the major portion thereof for attachment to a side surface of the base.

5. The bracket of claim 2 wherein said first and second side plates and said base plate extend from said back plate in the same general direction.

6. The bracket of claim 2 wherein said side plates are about equal in length to said back plate.

7. The bracket of claim 2 wherein said base plate and said side plates are configured in a manner permitting coplanar positioning when in use.

8. The bracket of claim 7 wherein said side plates face toward each other.

9. The bracket of claim 4, said back plate, said first side plate, said base plate and said coplanar extension being apertured to facilitate securing the bracket to the joist, the header and the base respectively.

10. The bracket of claim 2 comprised of metal.

11. The bracket of claim 10 wherein the metal is steel.

12. The bracket of claim 10 wherein the metal is aluminum.

13. The bracket of claim 2 comprised of plastic.

14. The bracket of claim 1 wherein said first and second side plates and said base plate extend from said back plate in the same general direction.

15. The bracket of claim 1 wherein said side plates are about equal in length to said back plate.

16. The bracket of claim 1 wherein said base plate and said side plates are configured in a manner permitting coplanar positioning when in use.

17. The bracket of claim 16 wherein said side plates face toward each other.

18. The bracket of claim 1 comprised of metal.

19. The bracket of claim 18 wherein the metal is steel.

20. The bracket of claim 18 wherein the metal is aluminum.

21. The bracket of claim 1 comprised of plastic.

22. A three component system for supporting a generally horizontal surface comprising:

a header having a generally vertical web and an upwardly facing side surface;

a plurality of joists abutting said header at spaced intervals along the length thereof, each of said joists having a generally vertical web and an upwardly facing side surface generally coplanar with the upwardly facing side surface of said header for supporting a generally horizontal surface;

a base having an upwardly facing surface supporting said header and the header abutting end of said plurality of joists; and a plurality of one piece brackets each comprising:

a back plate attached to the web of one of said joists, a first side plate laterally extending from a side of said back plate to effect the stiffening thereof and the stiffening of the web of the joist to which said back plate is attached, said first side plate being attached to the web of said header so that said back plate stiffens the web of said header, and a base plate laterally extending from said back plate to effect the stiffening thereof and thus of the web of the header, said base plate being attached to the upwardly extending surface of said base, whereby said header and said plurality of joists are attached to each other and to said base and provide support for a generally horizontal surface when overlain thereon.

23. The system of claim 22 wherein each of said one piece brackets includes a second side plate laterally extending from the other side of said back plate to effect the stiffening thereof and the stiffening of the web of the joist to which the back plate is attached.

24. The system of claim 23 wherein said base includes a side surface facing away from said header in the direction of said joists; and wherein said second side plate includes a coplanar extension attached to the side surface of said base.

25. The system of claim 22 wherein said side plates are L-shaped each comprising a major portion attached to the web of said header and a terminal minor portion extending generally toward the other of said side plates to effect the stiffening of the associated major portion to thereby (i) stiffen the web of the attached joist, and (ii) stiffen said back plate and thus the web of said header.

26. The system of claim 25 wherein said base plate and said side plates are configured in a manner permitting coplanar positioning when in use.

27. The system of claim 25 wherein said base plate and said side plates are configured to overlie each other so that they both may be fastened to the base with the same fastener.

28. The system of claim 22 wherein said plural joists are thin gauge metal.

29. The system of claim 28 wherein said plural joists are each C-shaped.

30. The system of claim 28 wherein said plural joists are each Z-shaped.

31. The system of claim 22 wherein said joists are C-shaped; wherein said back plate is attached to the outer facing side of the web of the attached one of said joists; and wherein the length of said back plate and said first side plate are about equal to the width of the web of said joist.

32. The system of claim 22 wherein said first side plate is L-shaped and comprises a major portion attached to the web of said header and a terminal minor portion extending generally away from said header to effect the stiffening of the major portion to thereby (i) stiffen the web of the attached joist, and (ii) stiffen said back plate and thus the web of said header.

33. The system of claim 22 including a second L-shaped side plate and comprises a major portion attached to said back plate and a terminal minor portion extending generally toward said header to effect the stiffening of the major portion to thereby (i) stiffen the web of the attached joist, and (ii) stiffen said back plate and thus the web of said header.

34. The system of claim 22 wherein each of said one piece brackets includes a second side plate laterally extending from the other side of said back plate to effect the stiffening thereof and the stiffening of the joist to which the back plate is attached, said second side plate including a coplanar extension attached to the side surface of said base.

35. The system of claim 22 wherein said web of said header has upper and lower extensions such that said header is either C-shaped or Z-shaped metal.

36. The system of claim 35 wherein the height of said back plate and said first side plate not greater than the height of the web of said header.

37. The system of claim 36 wherein said first side plate is an L-shaped plate comprising:

a major portion attached to the web of said header; and a minor terminal portion extending in a direction away from said header to effect the stiffening of the major portion (i) to thereby stiffen the web of said joist and (ii) to thereby stiffen said back plate and thus the web of said header.

38. The system of claim 36 wherein the upper and lower extensions of said header are in contact with said first minor portion to further stiffen the web of said header.

39. The system of claim 38 wherein said joists are C-shaped metal and wherein said back plate is attached to the outside facing web of said joist.

40. The system of claim 39 wherein said joists are either C-shaped or Z-shaped metal.

41. A two component system for securing joists to a girder comprising:

a girder having a generally vertical web and an upwardly facing side surface;

a plurality of joists supported by said girder at spaced intervals along the length thereof;

a plurality of one piece brackets each comprising:

a back plate attached to the web of one of said joists, a first side plate laterally extending from a side of said back plate to effect the stiffening thereof and the stiffening of the web of the joist to which said back plate is attached, a second side plate laterally extending from a side of said back plate to effect the stiffening thereof and the stiffening of the web of the joist to which said back plate is attached, and a base plate laterally extending from said back plate to effect the stiffening thereof and thus of the web of the joist, said base plate being attached to the upwardly extending surface of said girder, whereby said girder and said plurality of joists are attached to each other.

42. The system of claim 41 wherein said side plates are L-shaped.

43. The system of claim 42 wherein at least one of said side plates includes a coplanar extension for positioning said brackets with respect to said girder and for attaching said bracket to said girder.

44. The system of claim 43 wherein both of said side plates include a coplanar extension for positioning said brackets with respect to said girder and for attaching said bracket to said girder.

45. The system of claim 41 wherein both of said side plates include an coplanar extension for positioning said brackets with respect to said girder and for attaching said bracket to said girder.

46. A method of mutually attaching a C-shaped or Z-shaped metal header to an abutting C-shaped or Z-shaped metal joist to a supporting base with stiffening of the header and the joist comprising the steps of:

(a) providing a metal bracket with a back plate, a first generally normal extension from one end thereof and a second generally normal extension from one side thereof;

(b) positioning the bracket with the back plate overlying the web of the joist and with second extension overlying the web of the header and with the first extension overlying the base; and (c) securing surfaces of the bracket to the surfaces overlain so that the back plate serves to stiffen the web of the header, the second extension stiffens the back plate and thus the web of the header, and the first extension stiffens the back plate and the web of the joist, the securing also mutually attaching the header to the joist to the base, whereby the header and joist are stiffened and secured to the base.

47. The method of claim 46 wherein the bracket also includes a third generally normal extension from the other side of the back plate in the same general direction as the first extension therefrom; and including the further step of securing the third extension to the base, thereby to increase the stiffening (i) of the back plate and thus the header and (ii) of the web of the joist and to increase the security of the attachment of the header and joist to the base.

48. The method of claim 47 wherein each of the second and third extensions of the back plate includes a generally normal terminal end portion, thereby to increase the stiffening of the second and third extensions respectively and thus the stiffening of the web of the joist, the terminal end portion of the second extension also stiffening the web of the header.

49. A method of mutually attaching a C-shaped or Z-shaped metal joist to a girder with stiffening of the joist comprising the steps of:

(a) providing a metal bracket with a back plate, a first generally normal base plate extending from one end thereof and first and second generally normal side plates extending one each from opposite sides thereof;

(b) positioning the bracket with the back plate overlying the web of the joist and with the base plate overlying the girder and; and (c) securing the base plate of the bracket to the girder and the back plate to the web of the joist so that the back plate serves to stiffen web of the joist, the two side plates stiffen the back plate and thus the web of the joist whereby the joist is stiffened and secured to the girder.

* * * * *